US006290815B1

(12) United States Patent
Magnin et al.

(10) Patent No.: US 6,290,815 B1
(45) Date of Patent: Sep. 18, 2001

(54) PAPER-BASED SHEET AND ABRASION-RESISTANT LAMINATES

(75) Inventors: Henri Magnin, Charavines; Claude Perrin, Apprieu; Pierre Caulet, Charavines, all of (FR)

(73) Assignee: Arjo Wiggins S.A., Issy-les-Moulineaux (FR)

( * ) Notice: Subject to any disclaimer, the term of this patent is extended or adjusted under 35 U.S.C. 154(b) by 0 days.

(21) Appl. No.: 08/894,806

(22) PCT Filed: Jan. 14, 1997

(86) PCT No.: PCT/FR97/00055

§ 371 Date: Sep. 3, 1997

§ 102(e) Date: Sep. 3, 1997

(87) PCT Pub. No.: WO97/26410

PCT Pub. Date: Jul. 24, 1997

(30) Foreign Application Priority Data

Jan. 15, 1996 (FR) ..... 96 00380

(51) Int. Cl.[7] ..... D21H 27/28; D21H 17/69

(52) U.S. Cl. ..... 162/181.1; 162/158; 162/181.4; 162/181.6; 162/177; 162/168.1; 162/169; 162/164.4; 162/183

(58) Field of Search ..... 162/181.1, 181.2, 162/183, 181.4, 181.5, 181.6, 177; 428/323, 329, 331, 537.5, 158, 168.11, 169, 164.4, 164.1, 179, 183

(56) References Cited

U.S. PATENT DOCUMENTS

| | | | | |
|---|---|---|---|---|
| 3,661,673 | | 5/1972 | Aucun . | |
| 4,643,801 | * | 2/1987 | Johnson | 162/164.1 |
| 4,713,138 | * | 12/1987 | Ungar et al. | 156/307.4 |
| 5,093,185 | * | 3/1992 | Ungar et al. | 428/204 |
| 5,412,019 | * | 5/1995 | Roulstone et al. | 524/497 |
| 5,466,511 | * | 11/1995 | O'Dell et al. | 428/207 |

FOREIGN PATENT DOCUMENTS

| | | |
|---|---|---|
| A-O 505 230 | 9/1992 | (EP) . |
| A-1 543 107 | 10/1968 | (FR) . |
| A-1 574 068 | 9/1980 | (GB) . |
| WO-A-93/01935 | 2/1993 | (WO) . |

OTHER PUBLICATIONS

Database WPI, Section Ch, Week 9309, Derwent Publications Ltd., London, GB; AN 93–070329 XP002014120& JP 05 015 772 A (Nippon Junyaku KK), 26 Janvier 1993 cité dans la demande voir abrégé.

* cited by examiner

*Primary Examiner*—Jose Fortuna
(74) *Attorney, Agent, or Firm*—Bacon & Thomas

(57) ABSTRACT

The invention relates to a paper sheet containing grit particles giving it, in use, a high abrasion resistance. It is characterized in that it contains grit particles coated in a non-abrasive material, in particular in a polymer. According to the invention, the particles are chosen from alumina, silica, boron nitride, silicon carbide, titanium carbide, tungsten carbide, zirconium oxide, cerium oxide, glass and ceramic particles, or mixtures thereof. The invention also relates to the laminates containing it, as well as to the processes for manufacturing the sheets and the laminates.

27 Claims, No Drawings

PAPER-BASED SHEET AND ABRASION-RESISTANT LAMINATES

The invention relates to a paper sheet containing grit particles giving it, in use, high abrasion resistance. This sheet is used, in particular, in the manufacture of laminates in which it gives their surface increased abrasion resistance. The invention also relates to the laminates containing it, as well as to the processes for manufacturing the sheets and the laminates.

For many years, laminates have been employed as materials in dwellings and commercial and industrial premises. Typical applications of such laminates are floor coverings, in particular those imitating a parquet floor, coverings for furniture, table tops, chairs and other articles. They are consequently subjected to repeated rubbing which abrades their surface; a desired property of these laminates is therefore a high abrasion resistance, and in the case of floors it must be extremely high.

Abrasion resistance can be characterized by the so called Taber resistance, measured according to the NF-EN 483-2 (1991) standard and expressed as a number of revolutions. The abrasion resistance of a laminate should correspond to a Taber resistance of at least 4000 revolutions in the case of intensive domestic usage, and should reach 10,000 to 12,000 revolutions in the case of usage in public places.

Several kinds of decorative boards exist: so called high-pressure boards, so-called low-pressure boards and boards covered with a sheet called a finished, adhesive sheet.

So called high-pressure laminates are produced from a core consisting of resin-impregnated sheets. These sheets are generally made of kraft paper and have been impregnated with a thermosetting resin, usually a phenolic resin. After having impregnated the sheets with resin, they are dried, cut and then stacked one on top of another. The number of sheets in the stack depends on the applications and varies between 3 and 9, but may be higher. Next, a decorative sheet is placed on the stack of sheets forming the core. Such a decorative sheet is generally a sheet of paper bearing a printed or colour pattern or containing decorative particles, and it is impregnated with a thermosetting resin which does not darken with heat, for example melamine-formaldehyde resins, benzoguanamine formaldehyde resins and unsaturated polyester resins; sometimes this sheet is not impregnated, resin being provided by creep of the resin from the sheets which surround it. In general, placed on top of the decorative sheet is a protective covering sheet which is unpatterned and transparent in the final laminate; in the art, this protective sheet is called an "over-lay" or "overlay". Next, the stack of impregnated sheets is placed in a laminating press, the platens of which are provided with a metal sheet giving the laminate the surface finish. The stack is then densified by heating, at a temperature of about 110° C. to 170° C., and by pressing, with a pressure of about 5.5 MPa to 11 MPa, for approximately 25 to 35 minutes in order to obtain an integral structure. Next, this structure is fixed to a base support; for example, it is adhesively bonded to a particleboard.

The so-called low-pressure laminates are produced using only one decorative sheet impregnated with thermosetting resin and optionally an overlay sheet which is laminated directly onto the base support during a short cycle, the temperature being about 160 to 175° C. and the pressure 1.25 MPa to 1.6 MPa.

The third kind of decorative board consists of boards composed of a base support, generally a wood particleboard or a fibreboard, and of a decorative sheet of paper impregnated with a composition containing a binder or a melamine-formaldehyde resin and a polymer, this sheet being fixed to the support by means of an adhesive. In this case, the sheet of paper is a decorative sheet of uniform colour or one with decorative patterns. The color or the patterns are generally applied by printing on the sheet, before or after impregnation. In addition, a varnish or a lacquer is applied, for the purpose of protecting the surface of the sheet. An example of such a sheet, called a finished foil or impregnated foil, and the decorative board containing it are described in Patent Application WO-A-9517551.

The overlay protective sheet is conventionally manufactured by dewatering an aqueous suspension of very lightly refined cellulose fibers. This sheet has a low grammage, of between 10 and 50 g/m$^2$, and is not opacified. It is impregnated with a thermosetting resin, which leads to it being transparent in the final laminate and enables the decoration of the laminate to be seen. The resin is usually chosen from melamine resins, urea resins or unsaturated polyester resins. This overlay sheet protects the surface of the laminate and, in particular, it increases its abrasion resistance as it provides additional thermosetting resin. In order to have a very high abrasion resistance, it is necessary to use a high grammage overlay sheet, but this impairs the good visibility of the decoration through this sheet. This is the most common way of increasing the abrasion resistance of laminates. However, this resistance may also be increased by the use of particles having a high abrasiveness, and therefore being abrasion resistant, which are called in the art grit particles. Their abrasive character is due to their hardness and to their morphology, which exhibits many sharp edges. These particles are present in or on the overlay sheet or on the decorative sheet itself. In order not to impair the transparency of the overlay sheet after impregnation, these particles, on the one hand, must be transparent to translucent or have a white to greyish-white colour and, on the other hand, must not have too high an average size, this being preferably less than or equal to 200 $\mu$m, and must not be present in too great a quantity. However, in order to have high abrasion resistance, it is preferable for the size of the particles to be the highest possible and/or for these particles to be added in great quantity.

The use of very hard inorganic particles, such as, for example, those of alumina or corundum, of silica, including quartz, boron nitride, silicon carbide, titanium carbide and tungsten carbide, their Mohs hardness being between 3 and 10, or even higher, has thus been described. These particles have been mentioned in numerous patents, in particular in Patents GB-A-1,139,183, GB-A-1,378,879, DE-A-2,107,091, FR-A-2,104,707, FR-A-2,139,990, U.S. Pat. No. 3,661,673, U.S. Pat. No. 5,141,799 and CA 836,522. These particles may be introduced into or placed on the sheet of paper:

- by addition to the pulp stock during the manufacture of the sheet, although, since these particles have an abrasive character, the papermaking machine is rapidly worn; another drawback is that the particles are poorly retained in the paper;
- or by deposition using a second head box on the papermaking machine, but wear of the machine still occurs;
- or by impregnation or coating at the same time as the impregnation resin, after they have been mixed with the resin, and optionally after the sheet has been printed in the case of a decorative sheet; but with the drawback that it is difficult to make the mixture very homogeneous, segregation of the particles possibly occurring and thus giving rise to poor retention of the particles on the sheet;

or by deposition, in particular by electrostatic spraying, on the sheet pre-impregnated with resin, this process, described in Patent FR-B-2,104,707, filed in 1970, for helping to overcome the cited drawbacks of the prior art, reducing the number of manufacturing machines subjected to abrasion, although it is difficult to spray uniformly and spraying creates a dusty atmosphere.

Moreover, whatever the process for incorporating the grit particles, there is still rapid wear of the laminating machines, in particular of the metal sheets of the platens of laminating presses. One drawback of this wear of the metal sheets of the presses is that the surface finish which they give the laminates also deteriorates. This is particularly troublesome for obtaining high-gloss laminates since this gloss is essentially provided by the surface finish of the metal sheet; currently, it is therefore impossible to produce high-gloss laminates which are highly abrasion resistant.

For more than twenty-five years, attempts have therefore been made to introduce so-called grit particles into or placed on a cellulose sheet without, however, managing to avoid the wear of the machines for manufacturing the sheets and/or laminates.

Moreover, particles which have a certain abrasiveness and which are coated, more or less completely with another material, are known, in particular from the patent applications mentioned below. For example, in French Patent Application FR-A-1,543,107, filed in 1967, coatings have been described which comprise waxes, paraffins or fatty alcohols in order to coat solid substances used as additives for plastics or resins. This coating reduces the abrasive effect created by the solid substances, in particular titanium oxide, on the machines for manufacturing plastics or resins. This patent application therefore does not relate to a paper sheet and its purpose is not to obtain abrasion resistant products.

British Patent Application GB-A-1,574,068, filed in 1976, has described the coating of products such as fibers or pigments or microcapsules with a discrete layer of regenerated cellulose. This treatment reduces wear of the wire of the papermaking machine by these products because of the improvement in the retention of these products. The principle here is to retain the products as far as possible in the sheet during its formation and thus deposit less of the products on the wire of the papermaking machine, which therefore is less worn by them. The purpose is therefore not for the coating material to decrease directly the abrasiveness of the particles nor, a fortiori, for it to restore the abrasiveness subsequently.

Japanese Patent JP-B-93,007,063 from Mitsubishi has described inorganic particles, including alumina or silica particles, which are encapsulated in a polymer chosen, in particular, from polystyrenes and its derivatives, polymers of (meth)acrylic acid or of its alkyl esters, polyacrylamides, polyacrylonitriles and polyvinyl acetates.

Japanese Patent Application JP-A-05,015,772 from Nippon Junyaku has described inorganic particles, including alumina or silica particles, which are encapsulated in a copolymer of (meth)acrylic acid and of a vinyl monomer.

Patent Applications EP-A-380,428 or EP-A-505,230 from Rhone Poulenc have described the coating of mineral particles with organopolysiloxanes. The object sought here is to fill organopolysiloxane latices in order to give them superior mechanical properties, and it was found that encapsulating the fillers improved the synergy—the compatibility between these fillers and the latices. There is therefore no question of decreasing the abrasiveness of the mineral fillers.

In this prior art, the coating of the particles was carried out by those skilled in the art in order to obtain permanent coating of the particles, and not for the purpose of providing a sheet containing these particles, a sheet which would have a high abrasion resistance and/or would give the surface of a product containing it such resistance during its use.

The invention aims to solve the problems of the prior art relating to abrasion-resistant sheets by the incorporation of highly abrasive fillers and to the laminates containing them.

The main object of the invention is to provide a paper sheet, in particular a paper sheet used to manufacture decorative laminates, which contains grit particles, this sheet having a very high abrasion resistance and/or giving the product containing it such resistance, but the manufacture of which sheet and/or of which product comprising it does not cause rapid wear of the papermaking machines and/or of the machines for manufacturing the product containing it, in particular the metal sheets of the laminating presses.

Another object is to ensure that the distribution of particles is uniform.

Another object is to ensure that the grit particles do not impair the transparency or the decorative effect of the sheets which contain them.

Another, secondary object is to ensure that the grit particles are well retained or bonded to the paper.

It has been discovered that the main object of the invention is achieved if grit particles coated in a non-abrasive coating material are used. By "non-abrasive coating material" is meant that the said coating material has a lower hardness than the particles to be coated and that, by coating, it decreases the number and protrusion of the sharp edges which characterize the morphology of the particles. The coated grit particles have, in particular, an Einlehner abrasiveness, determined according to the test described in Example 1 below, which is less than that of the uncoated particles. The function of this coating material is to decrease the abrasive character of the uncoated particles sufficiently, thanks to this coating, to reduce wear of the machines during manufacture of the paper sheet and wear of the machines for manufacturing the products containing the sheet. Furthermore, this coating does not containing the sheet. Furthermore, this coating does not affect the abrasion resistance of the paper sheet since, when the latter is subsequently subjected to wear, the coating is not abrasion resistant and wears away on that part of the particles subjected to abrasion so that the abrasion resistant character of the sheet, due to the presence of the grit particles, can develop. The coating is therefore, at least in part, temporary and has the function of delaying the abrasive character of the particles. In fact, within the scope of the present invention, on the one hand, the coating prevents wear of the machines during manufacture of the sheet or of the laminates and, on the other hand, when the laminate obtained with the sheet is subjected to wear, the coating wears away.

Although coated fillers as described previously in the prior art are known and although it has been sought for more than twenty-five years, in particular in the field of decorative laminates, to reduce the wear of the machines for manufacturing the sheets containing these fillers and of the laminating machines, those skilled in the art have never as yet envisaged the solution recommended by the present invention. Those skilled in the art charged with developing an end product which is abrasion resistant because of the abrasive character of the particles have not considered, at the outset, eliminating, or at least reducing, this abrasive character of the particles.

In particular, the non-abrasive coating material is a polymer. The coating polymer may be a natural or synthetic polymer.

The coating, depending on its ionicity, may also provide superior retention of the particles; this ionicity may be adjusted during manufacture of the synthetic polymers.

The invention provides a paper sheet containing grit particles giving it, in use, a high abrasion resistance, which contains the said grit particles coated in a non-abrasive material. More particularly, the sheet of the invention is characterized in that the coated grit particles have an Einlehner abrasiveness, determined according to the test described in Example 1 below, of less than or equal to 55 $g/m^2$. Preferably, this Einlehner abrasiveness is less than or equal to 20 $g/m^2$.

In particular, the sheet according to the invention is characterized in that the so called grit particles are chosen from alumina, silica, boron nitride, silicon carbide, titanium carbide, tungsten carbide, zirconium oxide, cerium oxide, glass and ceramic particles, or mixtures thereof. Preferably, the particles are alumina particles. The particles may have various shapes; for example, they may be spherical, or approximately spherical, polyhedral, or even in the form of fibers; preferably, these particles before coating have many sharp edges. According to one special case, the coated grit particles have a size of between 10 and 200 $\mu$m, preferably between 20 and 150 $\mu$m. Preferably, the so-called grit particles have a Mohs hardness of at least 6, before coating.

More particularly, the coating material must have an optical appearance compatible with the use of the sheet which contains it, that is to say that it must not impair the transparency of the sheet when this sheet is an overlay or that it must have an appearance compatible with the decorative effect of the sheet when this sheet is a decorative sheet. In addition, it must not yellow when exposed to the temperature of lamination of the laminates containing the sheets; it must also not yellow over time. The coating material must be transparent to translucent or white to greyish white in order not to impair the visual appearance of the sheet which contains it, in particular when this sheet is used as an overlay, and therefore transparent, sheet. According to one special case of the invention, the nonabrasive material is a polymer. According to one special case of the invention, the coating polymer is chosen from organopolysiloxanes, homopolymers or copolymers of styrene and of its derivatives, homopolymers or copolymers of acrylic acids or esters, homopolymers or copolymers of methacrylic acids or esters, including poly (methylmethacrylate), vinyl homopolymers or copolymers, polylolefins and polysaccharides, including ethylcellulose. As polysaccharides, cellulose derivatives, such as ethylcellulose, or products such as chitin, in particular extracted from the shells of shellfish, may be used. Preferably, the polymer is chosen from polystyrene, poly (methylmethacrylate) and ethylcellulose. Preferably, the coating material represents from 1 to 10% by dry weight of the dry weight of the coated particles.

The sheets may be impregnated or coated with a composition, in particular with a thermosetting resin. According to one special case of the invention, the sheet is characterized in that it contains a thermosetting resin and more particularly in that the thermosetting resin is chosen from melamine resins, benzoguanamine resins, unsaturated-polyester resins and urea resins.

More particularly, the sheet according to the invention is characterized in that it contains between 1 and 70%, preferably between 20 and 40%, by dry weight of coated grit particles with respect to its total dry weight, excluding the weight of thermosetting resin, where appropriate.

The sheet according to the invention can be used as a protective covering sheet, called an overlay, which is placed on the decorative sheet of the laminate. Advantageously, this sheet makes it possible to obtain overlay sheets which are of low grammage but which, however, provide high abrasion resistance and therefore do not impair the good visibility of the decoration of the laminate lying underneath. The invention also relates to an overlay sheet for abrasion resistant laminates, which is characterized in that it contains the said sheet with the coated grit particles.

In another case, the sheet according to the invention can be used directly as the decorative sheet of the laminate. The invention also relates to a decorative sheet for abrasion resistant laminates, which is characterized in that it contains the said sheet with the coated grit particles.

The sheet according to the invention is obtained, using papermaking techniques, from a dispersion based on cellulose fibers in aqueous medium, the coated grit particles being to the furnish of the cellulose fibers. The dispersion preferably contains a wet-strength agent. If this is a sheet intended for decoration, the dispersion may furthermore contain opacifying or colouring pigments. Optionally, the sheet may consist of several plies, the uppermost ply containing the coated grit particles. The invention also relates to a process for manufacturing a paper sheet according to the invention, in which the grit particles in a form coated in the said non abrasive material are introduced into the sheet, optionally placed on the surface. In particular, the invention also relates to the process for manufacturing the sheet based on cellulose fibers using papermaking techniques, which is characterized in that the said grit particles coated in the said non abrasive material are added, to the papermaking machine's head box containing the cellulose fibers. The invention also relates to another special case of a process for manufacturing the sheet based on cellulose fibers using papermaking techniques, which is characterized in that the said grit particles coated in the said non abrasive material are added, by means of another head box on the papermaking machine, to the surface of the sheet being formed in the wet state. The coated grit particles may also be introduced by means of other techniques, as mentioned above, in particular using impregnation processes, especially as a mixture with a said impregnation resin, or using surface deposition processes. In particular, the surface deposition processes, especially coating or spraying processes, may be carried out on a sheet which is preimpregnated with a thermosetting resin and, optionally, after printing the sheet in the case of a decorative sheet. In all cases, the coated particles prevent wear of the machines employed.

The sheet according to the invention may also be a decorative sheet, called a finished foil, which can be used for the production of the third type of decorative board defined in the introductory part of the present document. This sheet may advantageously be printed, without causing wear of the printing machines.

The invention also relates to an abrasion resistant laminate which is characterized in that it contains a sheet according to the invention as the so called overlay sheet.

The invention also relates to an abrasion resistant laminate which is characterized in that it contains a sheet according to the invention as the decorative sheet.

According to one special case of the invention, the laminate containing the sheet with the coated particles is characterized in that its Taber abrasion resistance, measured according to the NF-EN-483-2 (1991) standard, is greater than or equal to 3000 revolutions. Optionally, the laminate may contain the sheet according to the invention as the decorative sheet and, in addition, a conventional overlay sheet (with no grit particles) for even greater abrasion resistance. In another possibility, the laminate may contain both a decorative sheet and an overlay sheet, both according to the invention, for even greater abrasion resistance.

According to one special case of the invention, the laminate is characterized in that it has a high gloss. This high gloss is obtained by virtue of the surface finish of the metal plates of the laminating press, this surface finish not being impaired by the abrasiveness of the grit particles as these particles are coated in the said non-abrasive material.

The invention also relates to the process for manufacturing a laminate, which is characterized in that at least one sheet containing the coated grit particles is placed on the stack of the various components of the laminate, and this sheet and the other components of the laminate are pressed together. In the case of a so called high-pressure laminate, the components of the laminate other than the sheet containing the coated grit particles are kraft sheets impregnated with thermosetting resin and the decorative sheet, it being optionally impregnated with a thermosetting resin, if this decorative sheet does not contain the coated grit fillers. In the case of a low-pressure laminate, the components of the laminate other than the sheet containing the coated grit particles are the support board, such as a particle board, and a decorative sheet impregnated with a thermosetting resin, if this decorative sheet does not contain the coated grit fillers.

The following non-limiting examples enable the invention to be more clearly understood:

COMPARATIVE EXAMPLE 1

A control sheet is produced using uncoated alumina grit particles. These alumina particles have a Knoop hardness of 2100, i.e. a Mohs hardness of 9; they have an average size of 100 $\mu$m. The alumina particles used are characterized by an Einlehner abrasiveness of 86 g/m$^2$. By way of comparison, determined under the same test conditions, the Einlehner abrasiveness of titanium oxide particles, which are among the most abrasive of the usual papermaking fillers, is 14 g/m$^2$.

The Einlehner abrasiveness of the particles was determined under the following test conditions:

The pigment is dried in an oven at 105° C. for 24 hours and then 10 g of this substance put into suspention in 1000 g of distilled water. The pH is readjusted to 6 using aluminium sulphate.

The principle of this measurement consists in making the highly agitated particles of the specimen to be tested flow between a moving object and a metal mesh. The standard duration of this test is 120 minutes, but may be decreased in the case of highly abrasive substances since the loss in mass of the metal cloth must not exceed 40 mg, i.e. 130 g/m$^2$.

In the present case, as the fillers to be tested are highly abrasive, the duration of the test is fixed at 30 minutes.

The abrasiveness of the substance to be tested represents the loss in mass of the metal cloth per m$^2$ and is determined, in g/m$^2$, according to the following formula for calculating it:

Einlehner abrasiveness=X'10–$^3$/305'10–$^6$, X being the difference in the masses of the cloth before and after abrasion in mg and 305'10$^{31\ 6}$ being the surface area of the cloth abraded in m$^2$.

An overlay control sheet is manufactured on a Fourdrinier-type papermaking machine using a composition, in aqueous medium, of cellulose fibers, refined to 20°SR (degrees Schopper-Riegler). The alumina particles are added, to the furnish of fibers. The sheet also contains 2% by dry weight of a wet-strength agent based on melamine-formaldehyde resin.

After drying, the sheet has a granmage of 43 g/m$^2$.

The ash content is determined at 420° C. according to the ISO 2144 (1987) standard; the sheet contains approximately 8.6% of inorganic matter consisting mostly of alumina, the rest of the inorganic matter being inorganic residues contained in the paper stock and the additives.

The sheet is impregnated with a melamine-formaldehyde resin in aqueous medium, the degree of impregnation being 72%, that is to say that there are approximately 72 grams of resin by dry weight per 100 grams of impregnated paper.

This sheet is laminated in order to manufacture a high-pressure laminate using the following method and operating conditions: 5 sheets of kraft paper impregnated with phenolic resin are stacked, followed by a printed decorative sheet, impregnated with melamine-formaldehyde resin, and finally, the impregnated overlay sheet is placed thereon. The platens of the laminating press are heated to 160° C. and a pressure of 6.9 MPa (70 kg/cm$^2$) is applied for 30 minutes.

The abrasion resistance of the laminate obtained is measured according to the NF-EN 438-2 (1991) standard, Section 6. This resistance is characterized by the average wear R, which is about 4300 revolutions.

EXAMPLE 2

The alumina particles of the control are coated, by suspending these particles in a fluidized bed and by vaporizing therein the polymer, poly(methyl methacrylate), dissolved beforehand in dichloromethane. Approximately 1.5% by weight of the coated particles is polymer. The size of the coated particles is substantially the same as that of the uncoated particles; the particles were coated with a thin film of polymer. Scanning electron microscopy confirmed that the film coating the alumina particles was continuous.

The Einlehner abrasiveness of the coated particles, measured under the conditions as for the control, is determined. This abrasiveness is 45 g/m$^2$, therefore markedly less than that of the control.

As for the control, an overlay sheet is manufactured on a Fourdrinier-type papermaking machine using a composition, in aqueous medium, of cellulose fibers, refined to 20°SR (degrees Schopper-Riegler). Alumina particles of the example, but coated in poly(methylmethacrylate), are added, to the furnish of fibers. The sheet also contains 2% by dry weight of a wet strength agent based on melamine-formaldehyde resin.

After drying, the sheet has a grammage of 38 g/m$^2$.

The ash content at 420° C. is determined according to the ISO 2144 (1987) standard; the sheet contains approximately 10% of inorganic matter consisting mostly of alumina, the rest of the inorganic matter being inorganic residues contained in the paper stock and the additives.

The sheet is impregnated with a melamine-formaldehyde resin in aqueous medium, the degree of impregnation being 70%, that is to say that there are approximately 70 grams of resin by dry weight per 100 grams of impregnated paper.

This sheet is laminated in order to manufacture a high-pressure laminate using the method and operating conditions of Comparative Example 1.

The abrasion resistance of the laminate obtained is measured according to the NF-EN 438-2 (1991) standard, Section 6. This resistance is characterized by the average wear R, which is about 4500 revolutions. This resistance has therefore been maintained compared to the control of Comparative Example 1.

A visual check is made that the coating polymer has not yellowed during lamination.

A check is also made that the presence of the coated fillers has not decreased the transparency of the sheet containing them compared to that of the control and that the decorative effect of the laminate has not been impaired. It is also checked that the mechanical properties (tensile strength and wet strength) and the porosity of the sheet of paper have been maintained with respect to the control.

EXAMPLE 3

The alumina particles of the control are coated, by suspending these particles in a fluidized bed and by vaporizing therein the polymer, polystyrene, dissolved beforehand in toluene. Approximately 2.5% by weight of the coated particles is polymer. The size of the coated particles is substantially the same as that of the uncoated particles; the particles were coated with a thin film of polymer. Scanning electron microscopy confirmed that the film coating the alumina particles was continuous.

The Einlehner abrasiveness of the coated particles, measured under the conditions as for the control, is determined. This abrasiveness is 15 g/m$^2$, therefore at the same level as that of titanium oxide particles and is almost six times less than that of the control.

As for the control and in Example 2, an overlay sheet is manufactured on a Fourdrinier type papermaking machine using a composition, in aqueous medium, of cellulose fibers, refined to 20°SR (degrees Schopper-Riegler). Alumina particles coated in polystyrene are added, to the furnish of fibers. The sheet also contains 2% by dry weight of a wet-strength agent based on melamine-formaldehyde resin.

After drying, the sheet has a grammage of 38 g/m$^2$.

The ash content is determined at 420° C. according to the ISO 2144 (1987) standard; the sheet contains approximately 9% of inorganic matter consisting mostly of alumina, the rest of the inorganic matter being inorganic residues contained in the paper stock and the additives.

The sheet is impregnated with a melamine-formaldehyde resin in aqueous medium, the degree of impregnation being 73%, that is to say that there are approximately 73 grams of resin by dry weight per 100 grams of impregnated paper.

This sheet is laminated in order to manufacture a high-pressure laminate using the method and operating conditions of Comparative Example 1.

The abrasion resistance of the laminate obtained is measured according to the NF-EN 438-2 (1991) standard, Section 6. This resistance is characterized by the average wear R, which is about 4000 revolutions. This resistance has therefore been maintained compared to the control of Comparative Example 1.

A visual check is made that the coating polymer has not yellowed during lamination.

A check is also made that the presence of the coated fillers has not decreased the transparency of the sheet containing them compared to that of the control and that the decorative effect of the laminate has not been impaired.

It is also checked that the mechanical properties (tensile strength and wet strength) and the porosity of the sheet of paper have been maintained with respect to the control.

EXAMPLE 4

The alumina particles of the control are coated, by suspending these particles in a fluidized bed and by vaporizing therein the polymer, ethylcellulose, dissolved beforehand in toluene. Approximately 1.5% by weight of the coated particles is polymer. The size of the coated particles is substantially the same as that of the uncoated particles; the particles were coated with a thin film of polymer. Scanning electron microscopy confirmed that the film coating the alumina particles was continuous.

The Einlehner abrasiveness of the coated particles, measured under the conditions as for the control, is determined. This abrasiveness is 55 g/m$^2$, therefore markedly less than that of the control.

As for the control, an overlay sheet is manufactured on a Fourdrinier-type papermaking machine using a composition, in aqueous medium, of cellulose fibers, refined to 20°SR (degrees Schopper-Riegler). Alumina particles of the example, but coated in ethylcellulose, are added, to the furnish of fibers. The sheet also contains 2% by dry weight of a wet-strength agent based on melamine-formaldehyde resin.

After drying, the sheet has a grammage of 38 g/m$^2$.

The ash content is determined at 420° C. according to the ISO 2144 (1987) standard; the sheet contains approximately 10% of inorganic matter consisting mostly of alumina, the rest of the inorganic matter being inorganic residues contained in the paper stock and the additives.

The sheet is impregnated with a melamine-formaldehyde resin in aqueous medium, the degree of impregnation being 70%, that is to say that there are approximately 70 grams of resin by dry weight per 100 grams of impregnated paper.

This sheet is laminated in order to manufacture a high-pressure laminate using the method and operating conditions of Comparative Example 1.

The abrasion resistance of the laminate obtained is measured according to the NF-EN 438-2 (1991) standard, Section 6. This resistance is characterized by the average wear R, which is about 4500 revolutions. This resistance has therefore been maintained compared to the control of Comparative Example 1.

A visual check is made that the coating polymer has not yellowed during lamination.

A check is also made that the presence of the coated fillers has not decreased the transparency of the sheet containing them compared to that of the control and that the decorative effect of the laminate has not been impaired. It is also checked that the mechanical properties (tensile strength and wet strength) and the porosity of the sheet of paper have been maintained with respect to the control.

What is claimed is:

1. A paper sheet containing grit particles giving it, in use, a high abrasion resistance, characterized in that it contains said grit particles individually pre-coated with a solid non-abrasive coating material; said coated grit particles have an average Einlehner abrasiveness of less than or equal to 55 g/m$^2$ and an average size of between 10–200 $\mu$m; said paper sheet being optionally impregnated or coated by a thermosetting resin, said resin not being part of the precoating of the abrasive particles but optionally containing additional pre-coated abrasive particles.

2. The sheet according to claim 1, characterized in that the non abrasive pre-coating material is a polymer.

3. The sheet according to claim 2, characterized in that the pre-coating polymer is chosen from organopolysiloxanes, homopolymers or copolymers of styrene based compounds, homopolymers or copolymers of acrylic acids or esters, homopolymers or copolymers of methacrylic acids or esters, vinyl homopolymers or copolymers, polyolefins and polysaccharides, including ethylcellulose.

4. The sheet of claim 3 wherein said homopolymer or copolymer of methacrylic acid or esters is poly(methyl methacrylate).

5. The sheet according to claim 2, characterized in that the pre-coating polymer represents from 1 to 10% by dry weight of the dry weight of the coated particles.

6. The sheet according to claim 1, characterized in that the grit particles have a Mohs hardness of at least 6, before pre-coating.

7. The sheet according to claim 1, characterized in that the particles are chosen from the group consisting of alumina, silica, boron nitride, silicon carbide, titanium carbide, tungsten carbide, zirconium oxide, cerium oxide, glass, ceramic particles, and mixtures thereof.

8. The paper sheet according to claim 1 impregnated or coated by a thermosetting resin, said resin not being part of the precoating of the abrasive particles but optionally containing additional precoated abrasive particles.

9. The sheet according to claim 8, characterized in that the resin is chosen from the group consisting of melamine resins, benzoguanamine resins, unsaturated-polyester resins and urea resins.

10. The sheet according to claim 1, characterized in that it contains between 1 and 70%, by dry weight of the said pre-coated particles with respect to its total dry weight, excluding the weight of the thermosetting resin.

11. The sheet of claim 10 wherein said sheet contains between 1% and 40% by dry weight of said pre-coated particles with respect to its total dry weight, excluding the weight of the thermosetting resin.

12. The sheet according to claim 1 which is in the form of an overlay sheet.

13. An abrasion resistant laminate, characterized in that it contains a sheet according to claim 12 as the overlay sheet.

14. The laminate according to claim 13, characterized in that its Taber abrasion resistance, measured according to the NF-EN-483-2 (1991) standard, is greater than or equal to 3000 revolutions.

15. The laminate according to claim 13, characterized in that it has a high gloss.

16. The sheet according to claim 1 which is in the form of a decorative sheet.

17. An abrasion-resistant laminate, characterized in that it contains a sheet according to claim 16 as the decorative sheet.

18. The paper sheet of claim 1 wherein said pre-coated grit particles have an average size between 20 and 150 $\mu$m.

19. A process for manufacturing a paper sheet containing grit particles which give the paper high abrasion resistance in use, characterized in that grit particles in a form individually pre-coated with solid non abrasive material are introduced into the sheet with the proviso that the coated grit particles have an average Einlehner abrasiveness of less than or equal to 55 g/m$^2$ and and average size of between 10–200 cm.

20. The process of claim 19 wherein said paper sheet is made from cellulose fibers using a paper making technique in which said grit particles individually pre-coated with said solid non-abrasive material are introduced into said paper sheet by adding said individually pre-coated grit particles to a paper making machine's head box containing the cellulose, fibers.

21. The process of claim 19 wherein said paper sheet is made from cellulose fibers and wherein 'said paper sheet is first formed in the wet state and then said grit particles individually pre-coated with said solid non-abrasive material are applied to a surface of said sheet formed in the wet state.

22. In an abrasive resistant paper sheet wherein said abrasive resistance is imparted to said sheet by the presence of grit particles as a component thereof; said paper sheet being optionally coated or impregnated with resin, wherein the improvement comprises:

said grit particles having a thin film pre-coating thereon which individually surrounds each grit particle; said thin film which surrounds each grit particle having a hardness which is less than the hardness of said grit particles whereby said coating around each of said grit particles renders said particles temporarily nonabrasive while said coating remains around said grit particles.

23. A method for manufacturing a paper sheet containing grit particles which give the sheet, in use, a high abrasion resistance; said process comprising individually pre-coating said grit particles with a solid nonabrasive coating material wherein said coating takes place in a fluidized bed; and then forming said paper sheet with said pre-coated grit particles as a component thereof; said pre-coated grit particles having an average Einlehner abrasiveness of less than or equal to 55 g/m$^2$ and an average size of between 10–200 $\mu$m.

24. A process for manufacturing a laminate which comprises placing a paper sheet on a stack of various components of said laminate and compressing said sheet and said other components of the laminate together;

said sheet being a paper sheet containing grit particles giving it in use, a high abrasion resistance;

said grit particles being individually pre-coated with a solid non-abrasive coating material;

said coated grit particles having an average Einlehner abrasiveness of less than or equal to 55 g/m$^2$ and an average size of between 10–20 $\mu$m; and said paper sheet being optionally impregnated or coated by a thermosetting resin, said resin not being part of the pre-coating of the abrasive particles but optionally containing additional pre-coated abrasive particles.

25. A method for manufacturing a paper sheet based on cellulose fibers;

said paper sheet containing grit particles giving it in use, a high abrasion resistance, said grit particles being individually pre-coated with a solid non-abrasive coating material and said coated grit particles having an average Einlehner abrasiveness of less than or equal to 55 g/m$^2$ and an average size of between 10–20/m and said paper sheet being impregnated with a thermosetting resin, said resin not being part of the pre-coating of the abrasive particles but optionally containing additional pre-coated abrasive particles;

said process comprising impregnating said pre-coated grit particles into said paper sheet by forming a mixture of said pre-coated grit particles and said thermosetting resin and then contacting said mixture with said sheet whereby said resin impregnates said sheet.

26. A process for manufacturing a paper sheet based on cellulose fibers; said paper sheet containing grit particles individually pre-coated with a solid non-abrasive coating material, said coated grit particles having an average Einlehner abrasiveness of less than or equal to 55 g/m$^2$ and an average size of between 10–20 $\mu$m and said paper sheet being coated by a thermosetting resin, said resin not being part of the pre-coating of the abrasive particles but optionally containing additional pre-coated abrasive particles;

wherein said process comprises coating said individually pre-coated grit particles onto the sheet as a mixture with said thermosetting resin.

27. A process for manufacturing a paper sheet based on cellulose fibers wherein said paper sheet contains grit particles giving it in use, high abrasion resistance; and said grit particles are individually pre-coated with a solid non-abrasive coating material and said coated grit particles have an average Einlehner abrasiveness of less than or equal to 55 $g/m^2$ and an average size of between 10–20 $\mu m$; said paper sheet being impregnated with a thermosetting resin, said resin not being part of the precoating of the abrasive particles but optionally containing additional pre-coated abrasive particles;

said process comprising impregnating said sheet with said thermosetting resin to form a pre-impregnated sheet and then depositing said pre-coated grit particles on said preimpregnated sheet.

* * * * *